US008128258B2

(12) United States Patent
Lodhie

(10) Patent No.: US 8,128,258 B2
(45) **Date of Patent: *Mar. 6, 2012**

(54) LED LIGHT

(76) Inventor: Pervaiz Lodhie, Rolling Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/956,000

(22) Filed: Nov. 30, 2010

(65) Prior Publication Data

US 2011/0122622 A1 May 26, 2011

Related U.S. Application Data

(63) Continuation of application No. 11/924,496, filed on Oct. 25, 2007, now Pat. No. 7,862,204.

(51) Int. Cl.
*F21V 21/00* (2006.01)

(52) U.S. Cl. ..... 362/249.02; 362/231; 362/800

(58) Field of Classification Search ..... 362/231, 362/646, 249.02, 294, 373, 555, 800
See application file for complete search history.

(56) References Cited

U.S. PATENT DOCUMENTS

| | | | |
|---|---|---|---|
| 1,800,078 | A | 4/1931 | Johnson |
| 1,838,789 | A | 12/1931 | Schepperle |
| 2,260,473 | A | 10/1941 | Minchillo |
| 2,408,643 | A | 10/1946 | Hoy |
| D195,310 | S | 5/1963 | Zagel |
| 3,183,346 | A | 5/1965 | Spaulding et al. |
| 3,474,381 | A | 10/1969 | Baldwin |
| 3,539,801 | A | 11/1970 | Bobrick |
| 3,603,918 | A | 9/1971 | Woertz |
| 3,718,816 | A | 2/1973 | Seelbach et al. |
| 3,980,368 | A | 9/1976 | Fremont |
| 4,190,309 | A | 2/1980 | Glass |
| 4,211,955 | A | 7/1980 | Ray |
| 4,214,295 | A | 7/1980 | Morton |
| 4,217,018 | A | 8/1980 | Yoshida et al. |
| 4,655,520 | A | 4/1987 | Cummings |
| 4,727,289 | A | 2/1988 | Uchida |
| 4,729,742 | A | 3/1988 | Onishi et al. |
| 4,772,869 | A | 9/1988 | Grammas et al. |
| 4,812,814 | A | 3/1989 | Elliott |
| 4,868,719 | A | 9/1989 | Kouchi et al. |
| 4,907,361 | A | 3/1990 | Villard |
| 4,965,457 | A | 10/1990 | Wrobel |
| 5,055,984 | A | 10/1991 | Hung et al. |
| D326,532 | S | 5/1992 | Hume et al. |
| 5,119,174 | A | 6/1992 | Chen |
| 5,151,679 | A | 9/1992 | Dimmick |
| 5,152,601 | A | 10/1992 | Ferng |
| 5,154,509 | A | 10/1992 | Wulfman et al. |

(Continued)

OTHER PUBLICATIONS

U.S. Appl. No. 11/928,349, filed Oct. 30, 2007, Lodhie.

(Continued)

*Primary Examiner* — Peggy A. Neils
(74) *Attorney, Agent, or Firm* — Alonzo & Associates; Arlyn Alonzo

(57) ABSTRACT

A Light-Emitting Diode ("LED") light including a housing with two ends, a base coupled to the housing at one of the two ends for connecting to an electrical fixture, the housing including vertical plates with a majority of higher-power LEDs mounted on the vertical plates at an angle of less than 75 degrees relative to the vertical plates. In one aspect, the LEDs are mounted in a column and row grid pattern. In one aspect, the housing includes a horizontal plate with lower-power LEDs mounted thereon. In one aspect, the LED light includes a temperature regulation device housed within its housing for heat dissipation.

5 Claims, 4 Drawing Sheets

U.S. PATENT DOCUMENTS

| | | | |
|---|---|---|---|
| 5,160,200 | A | 11/1992 | Cheselske |
| 5,160,201 | A | 11/1992 | Wrobel |
| 5,193,904 | A | 3/1993 | Rist et al. |
| 5,224,773 | A | 7/1993 | Arimura |
| 5,237,490 | A | 8/1993 | Ferng |
| 5,241,457 | A | 8/1993 | Sasajima et al. |
| 5,303,124 | A | 4/1994 | Wrobel |
| 5,353,209 | A | 10/1994 | Foottit |
| 5,390,092 | A | 2/1995 | Lin |
| 5,400,228 | A | 3/1995 | Kao |
| 5,410,453 | A | 4/1995 | Ruskouski |
| 5,453,729 | A | 9/1995 | Chu |
| 5,526,236 | A | 6/1996 | Burnes et al. |
| 5,567,036 | A | 10/1996 | Theobald et al. |
| 5,577,832 | A | 11/1996 | Lodhie |
| 5,580,163 | A | 12/1996 | Johnson |
| 5,585,783 | A | 12/1996 | Hall |
| 5,588,740 | A | 12/1996 | Kasuga |
| 5,599,086 | A | 2/1997 | Dutta |
| 5,629,607 | A | 5/1997 | Callahan et al. |
| 5,647,658 | A | 7/1997 | Ziadi |
| 5,661,374 | A | 8/1997 | Cassidy et al. |
| 5,661,645 | A | 8/1997 | Hochstein |
| D385,051 | S | 10/1997 | Wu |
| 5,702,177 | A | 12/1997 | Lin |
| D388,726 | S | 1/1998 | Wu |
| 5,710,560 | A | 1/1998 | Cohn |
| 5,765,940 | A | 6/1998 | Levy et al. |
| 5,772,315 | A | 6/1998 | Shen |
| 5,793,164 | A | 8/1998 | Authier |
| 5,803,585 | A | 9/1998 | Littman et al. |
| 5,806,965 | A | 9/1998 | Deese |
| D402,772 | S | 12/1998 | Lodhie |
| 5,842,297 | A | 12/1998 | Tung |
| D404,506 | S | 1/1999 | Lodhie |
| 5,855,268 | A | 1/1999 | Zoladz, Jr. |
| D405,201 | S | 2/1999 | Lodhie |
| 5,887,968 | A | 3/1999 | Logan |
| 5,921,660 | A | 7/1999 | Yu |
| 5,929,788 | A | 7/1999 | Vukosic |
| 5,947,588 | A | 9/1999 | Huang |
| 5,964,051 | A | 10/1999 | Loeber et al. |
| 5,984,494 | A | 11/1999 | Chapman et al. |
| 6,011,493 | A | 1/2000 | Bushell et al. |
| 6,013,985 | A | 1/2000 | Green et al. |
| D434,510 | S | 11/2000 | Lodhie |
| 6,152,568 | A | 11/2000 | Baba et al. |
| 6,220,722 | B1 | 4/2001 | Begemann |
| 6,227,679 | B1 | 5/2001 | Zhang et al. |
| 6,234,648 | B1 | 5/2001 | Borner et al. |
| 6,283,612 | B1 | 9/2001 | Hunter |
| 6,336,613 | B1 | 1/2002 | Roth |
| 6,345,902 | B2 | 2/2002 | Ohkohdo et al. |
| 6,371,636 | B1 | 4/2002 | Wesson |
| 6,457,270 | B1 | 10/2002 | Stark, III et al. |
| 6,457,410 | B1 | 10/2002 | Zerillo |
| 6,550,949 | B1 | 4/2003 | Bauer et al. |
| 6,580,228 | B1 | 6/2003 | Chen |
| 6,585,395 | B2 | 7/2003 | Luk |
| 6,598,996 | B1 | 7/2003 | Lodhie |
| 6,659,622 | B2 | 12/2003 | Katogi et al. |
| 6,659,623 | B2 | 12/2003 | Friend |
| 6,659,632 | B2 | 12/2003 | Chen |
| 6,700,502 | B1 | 3/2004 | Pederson |
| 6,722,771 | B1 | 4/2004 | Stephens |
| 6,768,047 | B2 | 7/2004 | Chang et al. |
| 6,814,459 | B2 | 11/2004 | Pederson |
| 6,908,214 | B2 | 6/2005 | Luk |
| 6,942,361 | B1 | 9/2005 | Kishimura et al. |
| 7,063,451 | B2 | 6/2006 | Shen |
| 7,111,957 | B2 | 9/2006 | Bernhart et al. |
| 7,234,832 | B2 | 6/2007 | Lippis et al. |
| 7,237,932 | B2 | 7/2007 | Ter Hovhannissian |
| 2002/0163805 | A1 | 11/2002 | Hubbell et al. |
| 2002/0171543 | A1 | 11/2002 | Abbe et al. |
| 2002/0196707 | A1 | 12/2002 | Kitchin et al. |
| 2003/0095404 | A1 | 5/2003 | Becks et al. |
| 2003/0102810 | A1 | 6/2003 | Cross et al. |
| 2004/0012959 | A1 | 1/2004 | Robertson et al. |
| 2004/0062041 | A1 | 4/2004 | Cross et al. |
| 2006/0109661 | A1 | 5/2006 | Coushaine et al. |

OTHER PUBLICATIONS

U.S. Appl. No. 29/302,219, filed Jan. 11, 2008, Lodhie.
U.S. Appl. No. 29/322,471, filed Aug. 5, 2008, Lodhie.
U.S. Appl. No. 29/323,210, filed Aug. 20, 2008, Lodhie.
U.S. Appl. No. 29/324,267, filed Sep. 9, 2008, Lodhie.
U.S. Appl. No. 11/924,496, filed Oct. 25, 2007, Lodhie.
U.S. Appl. No. 29/302,184, filed Jan. 11, 2008, Lodhie.
U.S. Appl. No. 12/137,337, filed Jun. 11, 2008, Lodhie.
U.S. Appl. No. 29/318,602, filed Jun. 10, 2008, Lodhie.
U.S. Appl. No. 29/318,604, filed Jun. 10, 2008, Lodhie.
Four (4) photographs of an LED light fixture that is commercially available.
LED light fixtures available on the following website: www.hollysolar.com.
LED light fixtures available on the following website: www.geblighting.com.

LED LIGHT

CLAIM OF PRIORITY UNDER 35 U.S.C. 120

The present Application for Patent is a continuation of patent application Ser. No. 11/924,496 entitled LED Light filed Oct. 25, 2007, now U.S. Pat. No. 7,862,204, assigned to the assignee (who is the listed inventor) hereof and hereby expressly incorporated by reference herein.

FIELD

This disclosure relates generally to lighting sources. More particularly, the disclosure relates to a Light-Emitting Diode ("LED") lighting source.

BACKGROUND

LED bulbs are light sources that use semiconductor materials rather than filaments to emit light. LED bulbs are generally more efficient light sources than incandescent light bulbs because LED bulbs are nearly monochromatic and emit light within a very narrow range of wavelengths. LED bulbs also generally last many times longer than incandescent light bulbs.

Light posts can be fitted with light sources to illuminate a street, parking lot, walkway, etc. Historically, incandescent lights with filament type bulbs have been used for illumination. Since incandescent light bulbs illuminate radially outward, the illumination is distributed approximately uniformly in all directions.

SUMMARY OF THE DISCLOSURE

According to one aspect, a Light-Emitting Diode ("LED") light comprising: a housing with a first end and a second end; a base coupled to the housing at the second end; and the housing comprising at least six vertical plates having higher-power LEDs mounted thereon in a column and row grid pattern; and wherein the higher-power LEDs form an angle of no greater than about seventy degrees relative to each of the at least six vertical plates on which the higher-power LEDs are mounted.

According to another aspect, a Light-Emitting Diode ("LED") light comprising: a housing with a first end and a second end; a base coupled to the housing at the second end; the housing comprising at least six vertical plates having higher-power LEDs mounted thereon, and wherein the higher-power LEDs form an angle of no greater than about seventy degrees relative to each of the at least six vertical plates on which the higher-power LEDs are mounted; a power supply housed within the housing to regulate power to the higher-power LEDs; and a temperature regulation device housed within the housing to dissipate heat.

According to another aspect, a Light-Emitting Diode ("LED") light comprising: a housing with a first end and a second end; a base coupled to the housing at the second end; the housing comprising at least six vertical plates having higher-power LEDs mounted thereon in a column and row grid pattern, and wherein the higher-power LEDs form an angle between 30 degrees and 60 degrees relative to each of the at least six vertical plates on which the higher-power LEDs are mounted; a horizontal plate mounted on the first end of the housing having lower-power LEDs mounted thereon; at least one power supply housed within the housing to regulate power to the higher-power LEDs and the lower-power LEDs; and a temperature regulation device housed within the housing to dissipate heat.

According to another aspect, a Light-Emitting Diode ("LED") light comprising: a housing with a first end and a second end; a base coupled to the housing at the second end; and the housing comprising four vertical plates having higher-power LEDs mounted thereon in a column and row grid pattern; and wherein the higher-power LEDs form an angle of no greater than about seventy degrees relative to each of the four vertical plates on which the higher-power LEDs are mounted.

According to another aspect, a Light-Emitting Diode ("LED") light comprising: a housing with a first end and a second end; a base coupled to the housing at the second end; and the housing comprising eight vertical plates having higher-power LEDs mounted thereon and wherein the housing forms an octagonal shape; and wherein the higher-power LEDs form an angle of no greater than about seventy degrees relative to each of the eight vertical plates on which the higher-power LEDs are mounted.

It is understood that other embodiments will become readily apparent to those skilled in the art from the following detailed description, wherein it is shown and described various embodiments by way of illustration. The drawings and detailed description are to be regarded as illustrative in nature and not as restrictive.

DETAILED DESCRIPTION

The detailed description set forth below in connection with the appended drawings is intended as a description of various embodiments of the present invention and is not intended to represent the only embodiments in which the present invention may be practiced. Each embodiment described in this disclosure is provided merely as an example or illustration of the present invention, and should not necessarily be construed as preferred or advantageous over other embodiments. The detailed description includes specific details for the purpose of providing a thorough understanding of the present invention. However, it will be apparent to those skilled in the art that the present invention may be practiced without these specific details. In some instances, well-known structures and devices are shown in block diagram form in order to avoid obscuring the concepts of the present invention. Acronyms and other descriptive terminology may be used merely for convenience and clarity and are not intended to limit the scope of the invention.

Figure 1:
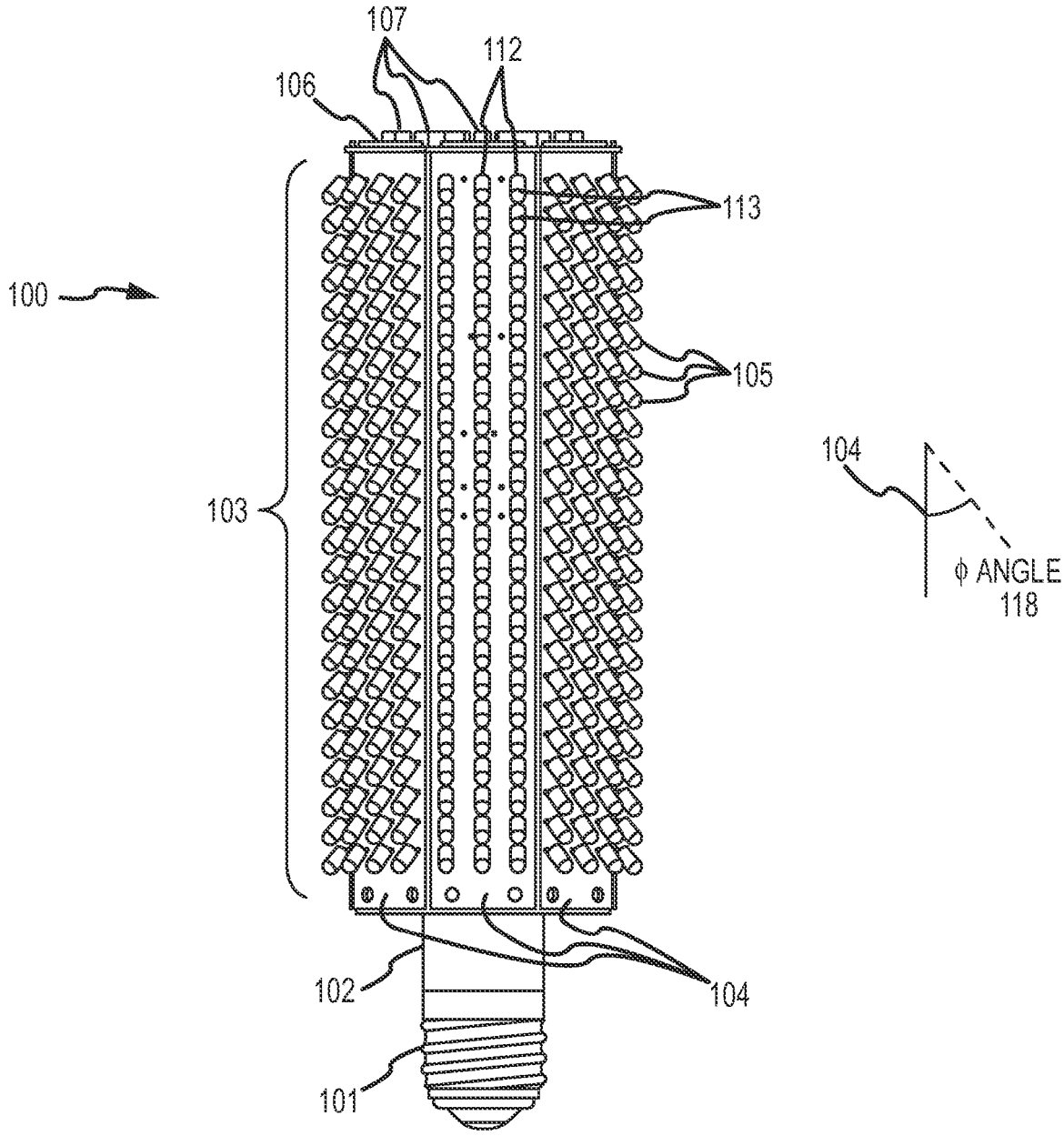
FIG. 1 is a side view of an exemplary LED light.

FIG. 1 is a side view of an exemplary LED light 100 with arrangements of LEDs pointed downwards toward the ground. One skilled in the art would understand that FIG. 1 presents an exemplary aspect of the LED light 100 in this disclosure. Various other aspects of the LED light 100 presented in FIG. 1 will be readily apparent to those skilled in the art without departing from the spirit or scope of the disclosure. Additionally, the dimensions shown in FIG. 1 are exemplary. Other dimensions will be readily apparent to those skilled in the art.

In one aspect, a base 101 for connecting to an electrical fixture is fixed to a shaft 102 that supports a housing 103. The housing 103 comprises of vertical plates 104 upon which higher-power LEDs 105 are mounted. The housing 103 further comprises a horizontal plate 106 upon which lower-power LEDs 107 are mounted. The term "higher-power" and "lower-power" are used here to illustrate the relative power wattage of the two types of LEDs 105 and 107. One skilled in the art would understand that power wattage are chosen based on the design application and will vary accordingly. In one aspect, the housing 103 comprises two horizontal plates 106, one mounted at the first end and one mounted at the second end. Each of the two horizontal plates includes lower power LEDs 107 mounted thereon. In one aspect, one of the two horizontal plates includes a cutout for the base 101. The housing 103 may also comprise a power supply 108 (not shown) to regulate power to the LEDs and a temperature regulation device 110 (not shown) within the housing to dissipate heat.

The base 101, for example, includes but is not limited to a mogul base, an Edison socket base, a bayonet base, a wedge base, a Candelabra base, a recessed single contact base, a single-pin base, a two-pin base, a three-pin base or a four-pin base. In one aspect, the base 101 allows an LED light 100 to be connected to standardized electrical fixtures. In another aspect, the base 101 is customized to fit a customized electrical fixture. FIG. 1 shows the base 101 on the end of the LED light 100 without the horizontal plate 106. Alternatively, the base 101 could be fixed to the end of the LED light 100 with the horizontal plate 106. In one aspect, the horizontal plate 106 includes a cutout to accommodate the base 101.

In one aspect, the vertical plates 104, for example, are arranged such that there are at least six vertical plates in a hexagonal shape (from the axial view). One skilled in the art would understand that the quantity of vertical plates is a designed choice and may be based on feasibility and manufacturing considerations. In one aspect, four vertical plates 104 are included. In another aspect, eight vertical plates 104 are included. In yet another aspect, ten or twelve vertical plates 104 are included. One skilled in the art would understand that although an even number of vertical plates are recited as examples, an odd number of vertical plates 104 may be included within the spirit and scope of this disclosure.

Figure 2:
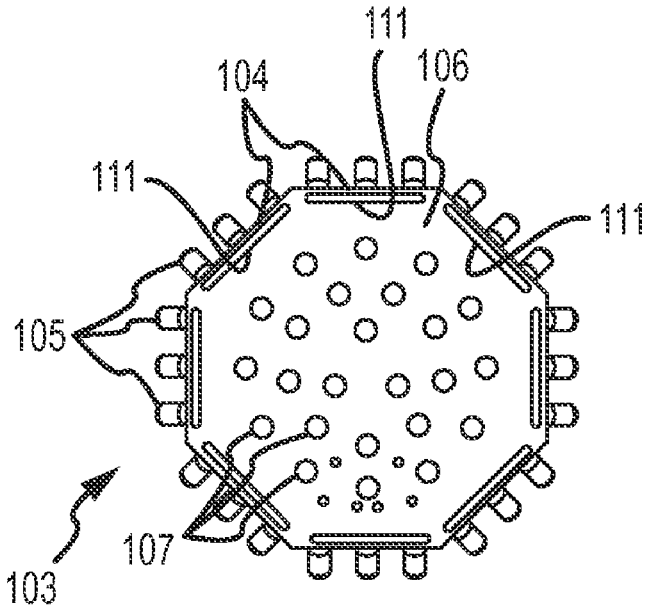
FIG. 2 is a top view of an exemplary LED light.

FIG. 2 is a top view of an exemplary LED light 100 and shows eight vertical plates arranged in an octagonal shape. In one aspect, the vertical plates 104 allow placement of a Printed Circuit Board ("PCB") 111 underneath each of the vertical plates 104 in order to electrically drive the higher-power LEDs 105 mounted thereon. Each of the vertical plates 104, for example, allows the higher-power LEDs 105 to be connected to the PCB 111 through the vertical plates 104. One skilled in the art would understand that the quantity of PCB does not have to equal the quantity of vertical plates. For example, an exemplary LED light 100 with eight vertical plates 104 arranged in an octagonal shape could include a single PCB for connection to the LEDs arranged on the eight vertical plates 104, or it could include eight PCBs, one PCB associated with each vertical plate, or any other quantity of PCBs chosen based on particular applications or manufacturing considerations.

In one aspect, the higher-power LEDs 105 mounted on the vertical plates 104, for example, are arranged as shown in FIG. 1 in columns 112 and rows 113 in a grid pattern. The quantity of LEDs 105 used in a LED light 100 is dependent on the particular application and desired illumination intensity. The arrangements of the higher-power LEDs 105 may include LEDs with narrow-beam angle and/or wide-beam angle. Alternatively, the higher-power LEDs 105 may also be composed of a combination of LEDs with narrow beam angles and wide beam angles designed to further spread out the light emitted from each of the higher-power LEDs 105. Generally, the narrower the LED beam angle, the further the emitted light may travel before losing its intensity. One skilled in the art would understand that the LED beam angle is a design parameter that is based upon the particular application. An example of an application is for the LED light 100 to illuminate a street and sidewalk surrounding a street post 117. One of ordinary skill in the art would recognize that the LED light 100 is not limited to the example of the street post 117, but may be adapted to other various applications, including indoor illumination.

Generally, each of the columns 112 is arranged running along the longer direction of the vertical plates 104 of the housing 103. In one aspect, the LED light 100 bulbs on the columns 112 are uniformly spaced apart from each other. Similarly, each of the rows is arranged running along the shorter direction of the vertical plates 104. In one aspect, the LED light 100 bulbs on the rows 113 are uniformly spaced apart from each other. In one aspect, each of the higher-power LEDs 105 is arranged at an angle 118 relative to the vertical plates 104 such that light emitted by the higher-power LEDs 105 is directed to illuminate the ground with its brightest intensity. In FIG. 1, the angle 118 is shown as $\phi$. The higher-power LEDs 105 are arranged on the vertical plates 104 at an angle 118 chosen to reduce illumination in directions that are perpendicular or near perpendicular to the vertical plates 104. In one example, the angle 118 is chosen to result in an LED illumination pattern that would reduce illumination into the eyes of drivers approaching the LED light 100 in an oncoming direction.

In one aspect, the angle 118 at which the higher-power LEDs 105 are mounted is chosen to reduce light pollution above the angle 118. Accordingly, the higher-power LEDs 105 are mounted so that they tilt toward the ground at an angle 118 to provide maximum desired ground illumination and reduce illumination pollution above an imaginary horizontal line of sight. In one aspect, the higher-power LEDs 105 are mounted at a maximum angle 118 $\phi$ of seventy degrees relative to their respective vertical plates to reduce light pollution for oncoming traffic. The angle 118 at greater than about seventy degrees relative to the vertical plates 104, for example, would not optimally reduce light pollution for oncoming traffic. In one aspect, the higher-power LEDs 105 form an angle between 30 degrees and 60 degrees relative to the vertical plates 104.

In one aspect, the minimum value of the angle 118 is limited by the physical characteristics of the LEDs. For example the physical circumference of the LEDs limits the minimum value of the angle 118 at which the LEDs can be mounted onto the vertical plates 104 while directing its illumination toward the ground. For example, the LEDs' height dimension will also limit the minimum value of the angle 118. Accordingly, the LEDs can only be angled toward the ground at a certain angle before it physically blocks a nearby LED bulb above or below it. Additionally, the overall physical size of the higher-power LED bulb limits the minimum angle relative to the vertical plates 104 it can be mounted. This minimum angle ensures reduced or no blockage to the light emitted from another nearby LED bulb. Thus, one skilled in the art would understand that the minimum value of the angle 118 is a design parameter dependent on various factors, such as but not limited to the dimensions of the LEDs. In one aspect, the angle 118 is about forty-five degrees.

In one aspect, a temperature regulation device 110 is included within the housing 103. The temperature regulation device 110, for example, may be an air circulation device such as a fan or a heat transfer device such as a heat sync. The temperature regulation device 110 uniformly dissipates heat collected within the housing 103 to reduce local hot spots on the LED light 100. Regulating heat dissipation can promote longer life span of the LEDs.

FIG. 2 is a top view of an exemplary LED light 100. In one aspect, the horizontal plate 106 is mounted on the end opposite the base 101. Alternatively, the horizontal plate 106 may be mounted on the same end as the base 101. The polygon shape of the horizontal plate 106 matches the polygon shape formed by the total quantity of vertical plates 104 in the housing. For example, if eight vertical plates 104 form an octagonally shaped perimeter of the LED light 100, then the horizontal plate 106 would have a corresponding octagonal shape to fit one end of the housing 103.

In one aspect, lower-power LEDs 107 are mounted on the horizontal plate 106 for illumination. In one aspect, the lower-power LEDs 107 are connected to a PCB 111 through the horizontal plate 106. A number of the lower-power LEDs 107 are mounted on the horizontal plate and arranged in a pattern to fill out the polygon shape of the horizontal plate 106. In one aspect, the lower-power LEDs 106 have low wattage and may have wide-angle beams to provide a soft glow and reduce lighting pollution above a predefined horizontal line of sight. In one aspect, when mounted to a street post 117, the lower-power LEDs 107 illuminate the aesthetic elements on one end of the street post 117 with a soft glow.

Figure 3:
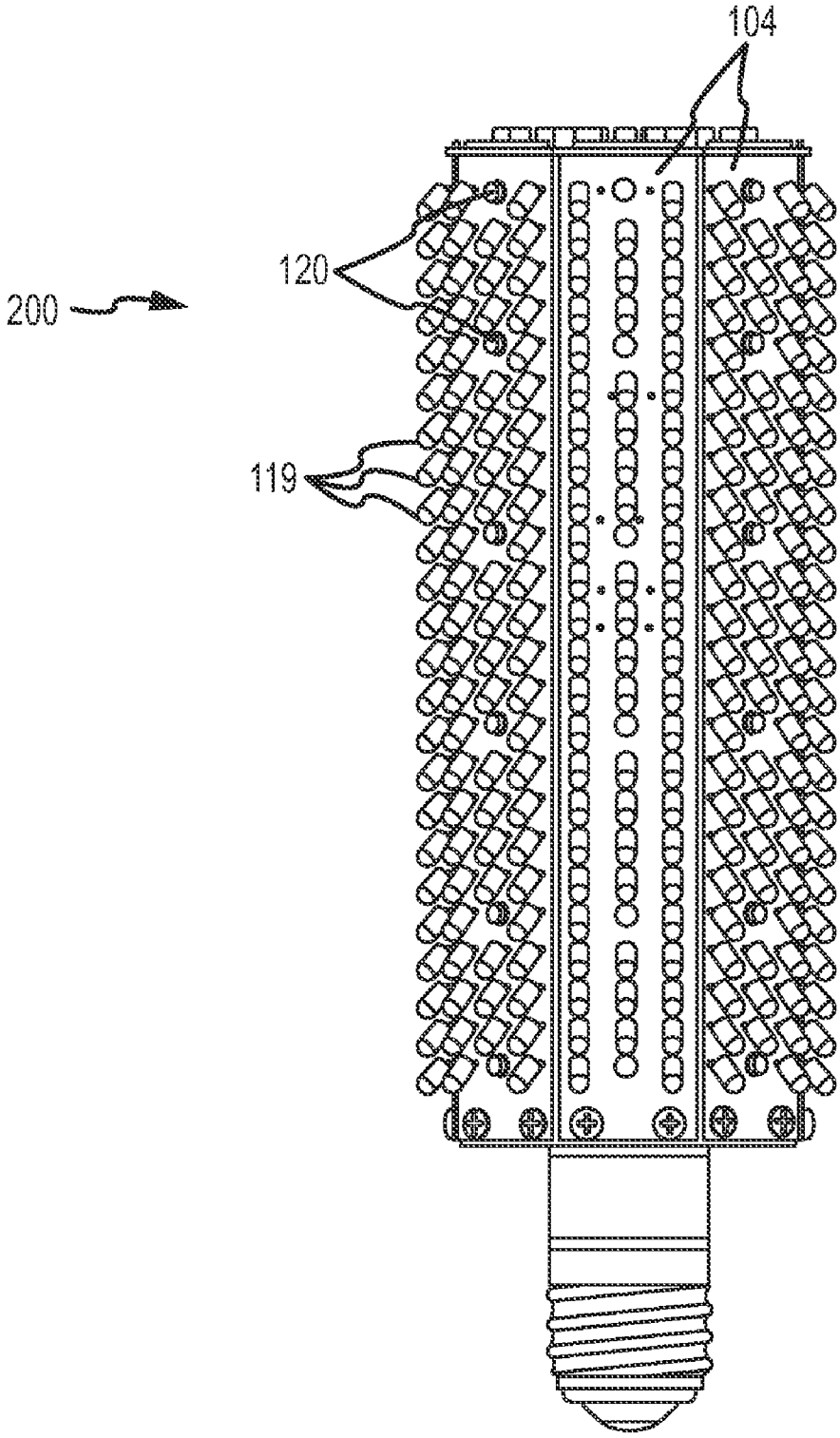
FIG. 3 is a side view of another exemplary LED light.
Figure 4:
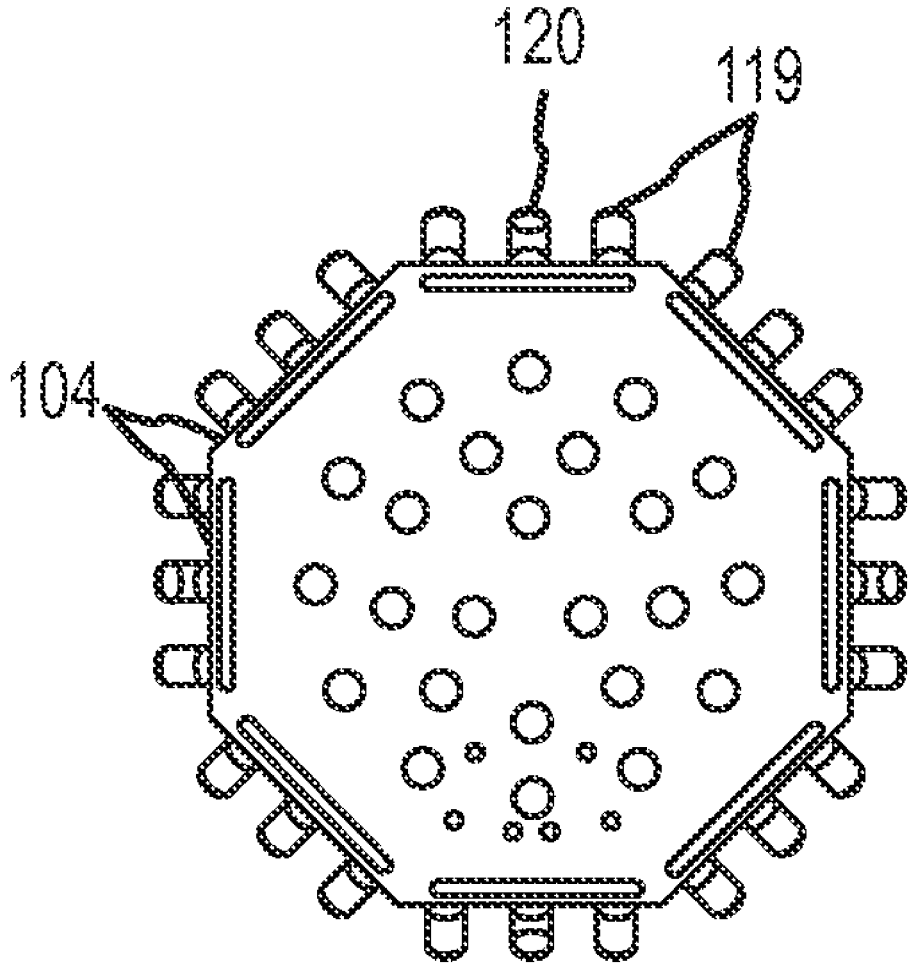
FIG. 4 is a top view of another exemplary LED light.

In one aspect, a majority of the higher-power LEDs are mounted at an angle 118 relative to the vertical plates 104. FIG. 3 is a side view of another exemplary LED light 200. Structures shown in FIG. 3 that are the same as those described in FIG. 1 have the same numbers. Descriptions of these structures are not repeated here unless necessary for context. LED light 200 includes a mixture of higher-power LEDs mounted at an angle 118 relative to the vertical plates 104 ("angled higher-power LEDs 119") and higher power LEDs mounted approximately perpendicular to the vertical plates 104 ("perpendicular higher-power LEDs 120"). FIG. 4 is a top view of another exemplary LED light 200 showing an exemplary arrangement of angled higher-power LEDs 119 and perpendicular higher-power LEDs 120 mounted on the vertical plates 104. One skilled in the art would understand that the mixture ratio of angled higher-power LEDs 119 and perpendicular higher-power LEDs 120 is dependent on design choice and application parameters. In one aspect, about 8% to 10% of the higher-power LEDs mounted on the vertical plates 104 are mounted approximately perpendicular to the vertical plates 104 to provide added illumination to the surrounding LEDs. One skilled in the art would understand that to be mounted approximately perpendicular to the vertical plates 104 could include being mounted perpendicular to the vertical plates 104.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention.

The invention claimed is:

1. A Light-Emitting Diode ("LED") light comprising:

a housing with a first end and a second end;

a base coupled to the housing at the second end; and the housing comprising at least six vertical plates having higher-power LEDs mounted thereon in a column and row grid pattern;

wherein at least a majority of the higher-power LEDs form an angle of no greater than about seventy degrees relative to each of the at least six vertical plates on which the higher-power LEDs are mounted;

wherein the housing further comprises a first horizontal plate at the first end of the housing having a first plurality of lower-power LEDs mounted thereon and a second horizontal plate at the second end of the housing having a second plurality of lower-power LEDs mounted thereon and the second horizontal plate includes a cutout for the base; and wherein the higher-power LEDs comprise at least one LED with narrow beam angle and at least one LED with wide-beam angle.

2. The LED light of claim 1, wherein the higher-power LEDs mounted on the vertical plates are directional LEDs.

3. The LED light of claim 2 further comprising a first printed circuit board coupled to the higher-power LEDs and a second printed circuit board coupled to the first and second pluralities of lower-power LEDs.

4. The LED light of claim 3 wherein the angle is about forty-five degrees.

5. The LED light of claim 1 wherein the base comprises one of a mogul base, an Edison socket base, a bayonet base, a wedge base, a Candelabra base, a recessed single contact base, a single-pin base, a two-pin base, a three-pin base or a four-pin base.

* * * * *